US009351078B2

(12) United States Patent
Huang

(10) Patent No.: US 9,351,078 B2
(45) Date of Patent: May 24, 2016

(54) VIBRATING PANEL DEVICE FOR ELECTROMAGNETIC VIBRATOR AND ITS MANUFACTURE METHOD

(75) Inventor: Xinmin Huang, Ningbo (CN)

(73) Assignee: Tang Band Industries Co., Ltd., Ningbo, Zhejiang (CN)

( * ) Notice: Subject to any disclaimer, the term of this patent is extended or adjusted under 35 U.S.C. 154(b) by 0 days.

(21) Appl. No.: 13/806,949

(22) PCT Filed: Apr. 12, 2012

(86) PCT No.: PCT/CN2012/073917

§ 371 (c)(1), (2), (4) Date: Dec. 26, 2012

(87) PCT Pub. No.: WO2012/155726

PCT Pub. Date: Nov. 22, 2012

(65) Prior Publication Data

US 2014/0064525 A1 Mar. 6, 2014

(30) Foreign Application Priority Data

May 19, 2011 (CN) ..... 2011 1 0132477
May 19, 2011 (CN) ..... 2011 2 0164230 U
Mar. 26, 2012 (CN) ..... 2012 1 0082195
Mar. 26, 2012 (CN) ..... 2012 2 0117869 U

(51) Int. Cl.

| | |
|---|---|
| ***H04R 7/10*** | (2006.01) |
| ***H04R 31/00*** | (2006.01) |
| ***H04R 7/08*** | (2006.01) |
| *H04R 7/18* | (2006.01) |
| *H04R 9/04* | (2006.01) |

(52) U.S. Cl.

CPC .. *H04R 7/10* (2013.01); *H04R 7/08* (2013.01); *H04R 31/00* (2013.01); *H04R 7/18* (2013.01); *H04R 9/046* (2013.01); *H04R 31/006* (2013.01); *Y10T 29/4908* (2015.01)

(58) Field of Classification Search

CPC ..... H04R 7/02; H04R 7/04; H04R 7/16; H04R 7/18; H04R 7/20; H04R 9/04; H04R 9/041; H04R 9/045; H04R 9/046; H04R 2231/001; H04R 2231/003; H04R 2307/201; H04R 2307/204; H04R 2307/207

USPC ..... 381/191, 431, 398, 334, 152, 162, 386, 381/395; 181/171, 172, 173

See application file for complete search history.

(56) References Cited

U.S. PATENT DOCUMENTS 4,928,312 A * 5/1990 Hill ..... 381/424
5,521,886 A * 5/1996 Hirosawa et al. ..... 367/174
5,892,184 A * 4/1999 D'Hoogh ..... 181/171

(Continued)

*Primary Examiner* — Curtis Kuntz
*Assistant Examiner* — Joshua Kaufman
(74) *Attorney, Agent, or Firm* — Raymond Y. Chan; David and Raymond Patent Firm

(57) ABSTRACT

A vibrating panel device for an electromagnetic vibrator includes at least one vibrating panel device. The vibrating panel module includes a base, a vibrating panel and an upper suspension, wherein an inner edge and an outer edge of the upper suspension are respectively connected with the base and the vibrating panel, and form an integrated whole body. Furthermore, two vibrating panel modules are fixedly connected in opposite directions to form the vibrating panel device. When the voice coil drives the vibrating panel to actuate, shaking of the vibrating panels is offset due to interactions between a pair of the suspensions and a pair of the vibrating panels. As a result, the voice coil drives the vibrating panel to process vertical up-and-down stroke.

3 Claims, 6 Drawing Sheets

(56) References Cited

U.S. PATENT DOCUMENTS

| | | | | |
|---|---|---|---|---|
| 6,160,898 | A * | 12/2000 | Bachmann et al. | 381/425 |
| 6,171,534 | B1 * | 1/2001 | Leach et al. | 264/102 |
| 6,490,363 | B1 * | 12/2002 | Liu | 381/403 |
| 6,675,931 | B2 * | 1/2004 | Sahyoun | 181/157 |
| 6,895,097 | B2 * | 5/2005 | Furuyama | 381/152 |
| 7,428,946 | B2 * | 9/2008 | Honda et al. | 181/171 |
| 7,505,603 | B2 * | 3/2009 | Yoo | 381/404 |
| 8,705,790 | B2 * | 4/2014 | Kuze | 381/423 |
| 9,025,808 | B2 * | 5/2015 | Kwon et al. | 381/398 |
| 9,027,700 | B2 * | 5/2015 | Kim et al. | 181/171 |
| 9,107,002 | B2 * | 8/2015 | Fujitani | H04R 7/127 |
| 2006/0110001 | A1 * | 5/2006 | Saint Vincent et al. | 381/396 |
| 2007/0071274 | A1 * | 3/2007 | Andersen et al. | 381/404 |
| 2008/0080736 | A1 * | 4/2008 | Sumitani et al. | 381/407 |
| 2010/0220888 | A1 * | 9/2010 | Huang | 381/400 |
| 2010/0322458 | A1 * | 12/2010 | Takewa | 381/398 |
| 2011/0002484 | A1 * | 1/2011 | Hama | 381/152 |
| 2011/0064260 | A1 * | 3/2011 | Andersen et al. | 381/430 |
| 2011/0228949 | A1 * | 9/2011 | Haba et al. | 381/86 |
| 2012/0237076 | A1 * | 9/2012 | Kuze | 381/387 |
| 2013/0064413 | A1 * | 3/2013 | Cazes Bouchet | 381/396 |
| 2013/0070953 | A1 * | 3/2013 | Dodd et al. | 381/398 |
| 2013/0259291 | A1 * | 10/2013 | Fujitani | 381/423 |
| 2014/0169593 | A1 * | 6/2014 | Kwon et al. | 381/185 |
| 2014/0318885 | A1 * | 10/2014 | Kim et al. | 181/171 |
| 2015/0208172 | A1 * | 7/2015 | Kim | H04R 7/02 381/398 |

* cited by examiner

VIBRATING PANEL DEVICE FOR ELECTROMAGNETIC VIBRATOR AND ITS MANUFACTURE METHOD

CROSS REFERENCE OF RELATED APPLICATION

This is a U.S. National Stage under 35 U.S.C 371 of the International Application PCT/CN2012/073917, filed Apr. 12, 2012, which claims priority under 35 U.S.C. 119(a-d) to CN 201110132477.1, filed May 19, 2011; CN 201120164230.3, filed May 19, 2011; CN 201210082195.X, filed Mar. 26, 2012; and CN 201220117869.0, filed Mar. 26, 2012.

BACKGROUND OF THE PRESENT INVENTION

1. Field of Invention

The present invention mainly relates to an electromagnetic vibrating device, and more particularly to a vibrating panel device which utilizes a pair of vibrating panel modules buckled in opposite sides and fixed, or utilizes an upper suspension and a lower suspension in opposite directions which are respectively connected and fixed with upper and lower surfaces of a vibrating panel and a base, so as to replace functions of a conventional damper, and its manufacture method.

2. Description of Related Arts

It is well known that electromagnetic vibrator, also called loudspeaker and commonly known as horn speaker, is a kind of electro-acoustic device converting electrical energy into acoustic energy. A process for manufacturing conventional loudspeakers comprises steps of: bonding a T-yoke or a U-yoke, bonding a cone frame and a magnetic circuit, installing a terminal, installing a damper, inserting a voice coil, installing a cone paper suspension and etc. Firstly, the required elements are prepared, and then manufacturing is processed from top to bottom and from inside out by hand. The damper, also called spider, is a main element in a paper-cone loudspeaker vibrating system. The damper is a corrugated type circular ring which is made by processing hot-pressing on materials of cotton cloth, silk, glass cloth and etc. which are soaked in phenolic resin. The main effects of the damper are as following.

(1) Maintains the proper position of the voice coil in a magnet gap, which requires the damper to have great compliance in an axial direction, in such a manner that the voice coil is capable of vibrating vertically in the magnet gap; and requires the damper to be capable of restricting left-right movement of the voice coil reliably, in such a manner that the voice coil is not in contact with the washer and the T-yoke.

(2) The damper, which is a supporting element, provides the loudspeaker with a restoring force and influences the mechanical Q factor, i.e., the damping characteristic, of the loudspeaker.

(3) The damper, the paper cone and the voice coil together determine the resonance the frequency of the loudspeaker.

(4) The damper of a compound-edge loudspeaker serves as a buffer and a mechanical amplitude limiter.

Based on the effects of the damper mentioned above, in conventional loudspeakers, an inner ring of the damper is fixedly connected with the voice coil and an outer ring surface of the damper needs to be fixedly connected with a base frame of the loudspeaker, which limits the thickness of the loudspeaker to a certain extent.

However, with the development of society and the continuously improvement of people's living standard, people not only require electronic products, such as LCD TV (Liquid Crystal Display Television), lap-top computer and mobile phone, to have low thickness, but also concern the sound quality of the electronic products. Referring to FIG. 1 of the drawings, when an ordinary loudspeaker is applied to these electronic products, the thickness of the loudspeaker is limited due to the effect of the structures of conventional loudspeakers, wherein the most common structure is a cone-shape or arc-shape vibrating cone paper bonded to a fiber damper which is soaked in resin. For the conventional loudspeakers to maintain a round-trip stroke, a conventional ring shaped damper is boned with a voice coil, then the voice coil is boned with conventional cone paper, further the cone paper is bonded with a suspension. By gluing an inner connecting surface of the damper, the voice coil is fixedly mounted on a middle portion of the magnetic circuit system; an outer connecting surface of the damper is fixedly mounted on the base of the loudspeaker by gluing as well. An inner edge of the vibrating cone paper of the loudspeaker is also fixed with the voice coil by gluing; an outer edge of the vibrating cone paper is fixedly mounted on the base frame of the loudspeaker by gluing the suspension thereon. In the integrated loudspeaker, the damper and the suspension support and fix the suspension system of the entire loudspeaker. Thus, due to the conventional shape of the vibrating cone paper and the suspension and due to structures of the conventional damper, the structure of the conventional damper is influenced and can not be thinned. When the whole loudspeaker is operating up-and-down piston movement, the suspension and the damper operate axial movements, both the suspension and the damper are fixed on the cone frame, i.e., base frame, of the loudspeaker. The suspension is on the top edge of the base frame, and the damper is on the bottom of the base frame. Especially when high-power is inputted, the up-and-down motion amplitude increases, and the effect caused by different manufacture materials of the suspension and the damper exists, so that the entire suspension system is hard to operate up-and-down movement in a straight line, which probably leads to collision between the voice coil and the magnetic circuit system when the voice coil is moving. Further, the application of conventional damper limits thickness of the loudspeaker, and the loudspeaker is not capable of reaching requirements of the electronic products. In addition, as time goes by, aging or degumming will appear on the glue, which causes that the sound quality of the loudspeaker changes or the whole loudspeaker damages.

Furthermore, from the appearance point of view, the passive radiator enclosure on the currently market has two loudspeakers. In fact one of the loudspeakers thereof is "fake". The "fake" loudspeaker only has a suspension and a vibrating panel mounted on the box body thereof and is not capable of working independently. The "fake" loudspeaker is actually just an auxiliary vibrator whose operation is driven by the sound wave generated by the operation of the other loudspeaker, so as to achieve better sound quality. However, since the auxiliary vibrator only has one suspension to fix the vibrating panel, the stroke of the vibrating panel is easy to be unbalanced, so that noise is generated and the sound quality is reduced.

SUMMARY OF THE PRESENT INVENTION

A main object of the present invention is to provide a vibrating panel device for an electromagnetic vibrator which comprises at least one vibrating panel module. The vibrating panel module comprises a base, a vibrating panel and an upper suspension, wherein an inner edge and an outer edge of the upper suspension are respectively connected with the base and the vibrating panel to form an integrated whole body. Further, a pair of the vibrating panel modules are fixedly connected in opposite directions to form the vibrating panel device. By means of unique structures of the vibrating panel device, when the voice coil drives the vibrating panel to actuate, shaking of the vibrating panels while actuating is offset due to interactions between a pair of the suspensions and a pair of the vibrating panels, in such a manner that the voice coil drives the vibrating panel to process vertical up-and-down stroke, so as to replace a conventional damper.

A second object of the present invention is to provide a manufacture method of a vibrating panel device for an electromagnetic vibrator which comprises the steps of:

putting the upper suspension and the vibrating panel into a base mold, integrating into a whole body by insert molding to form the vibrating panel module; and fixedly buckling a pair of the vibrating panel modules in opposite sides.

The vibrating panel device for the electromagnetic vibrator of the present invention relies entirely on special designing of industrial structure and unique manufacture process to replace application of glue, so as to achieve an object of improving product quality and product qualification ratio.

A third object of the present invention is to provide a vibrating panel device for an electromagnetic vibrator. When the vibrating panel device is applied in a passive radiator enclosure to serve as an auxiliary vibrator, the vibrating panel is ensured to process vertical and balanced up-and-down stroke better by unique structure.

Accordingly, in order to accomplish the above objects, technical solutions adopted by the present invention are as following. A vibrating panel device for an electromagnetic vibrator is provided, which comprises at least one vibrating panel module, wherein the vibrating panel module comprises a base, a vibrating panel and an upper suspension, wherein the base has:

an inner surface which circles inside the base, so as to form a through hole;

at least one connecting portion provided on a periphery of a bottom of the base for fixedly mounting a peripheral cone frame of the electromagnetic vibrator;

a first button mounted on a first side of a bottom of the base, and a first button hole mounted on a second side of a bottom of the base for coupling with the first button, in such a manner that when a pair of the vibrating panel modules are adopted, by rotating one vibrating panel module thereof for 180 degrees, the first button and the first button hole are fixedly buckled to form the vibrating panel device.

In addition, the vibrating panel is provided on a middle portion of the through hole on the base, and has an upper surface and a lower surface. A second button and a second button hole are provided on the lower surface of the vibrating panel. The second button is mounted on a first side of a lower surface of the vibrating panel, the second button hole is provided on a second side of the lower surface of the vibrating panel for coupling with the second button, in such a manner that when a pair of the vibrating panel modules are adopted, by rotating a vibrating panel module thereof for 180 degrees, the second button and the second button hole are buckled to firmly bond the pair of the vibrating panel modules together.

Further, an inner edge of the upper suspension is fixedly connected with a periphery of the upper surface of the vibrating panel, and an outer edge of the upper suspension is mounted on the base.

It is worth mentioning that, the vibrating panel device is formed by the vibrating panel module and a lower suspension. The lower suspension and the upper suspension are in opposite directions. An inner edge of the lower suspension is fixedly connected with a periphery of the lower surface of the vibrating panel, and an outer edge of the lower suspension is mounted on the base.

It is worth mentioning that when the vibrating panel device is applied to an electromagnetic vibrator, an electromagnetic vibrator comprises a vibrating panel device, a voice coil, a magnetic circuit system and a peripheral cone frame, wherein a first end of the voice coil is fixedly provided on a voice coil mounting portion on a lower surface of the vibrating panel, a second end of the voice coil is provided inside the magnetic circuit system; a first end of the peripheral cone frame is fixedly connected with the magnetic circuit system, and a second end of the peripheral cone frame is fixedly connected with the connecting portion on the base, in such a manner that an integrated whole body is formed.

It is worth mentioning that when the vibrating panel device is applied to a loudspeaker box to serve as an auxiliary vibrator, the vibrating panel device is fixed on an auxiliary vibrator mounting portion on a body of the loudspeaker box, in such a manner that acoustic wave generated by the loudspeaker while working drives the vibrating panel device to vibrate vertically up-and-down with balanced amplitude.

Further, a manufacture method of a vibrating panel device for an electromagnetic vibrator is provided which comprises the steps of:

(a) putting the upper suspension and the vibrating panel into a base mold, integrating by insert molding to form the vibrating panel;

(b) mounting a pair of the vibrating panel modules in opposite directions, so as to form the vibrating panel device.

Beneficial effects of the present invention are as following.

A vibrating panel device for an electromagnetic vibrator is provided, which comprises at least one vibrating panel module. The vibrating panel module comprises a base, a vibrating panel and an upper suspension, wherein an inner edge and an outer edge of the upper suspension are respectively connected with the base and the vibrating panel, and form an integrated whole body. Further, two of the vibrating panel modules are fixedly connected in opposite directions to form the vibrating panel device. By means of unique structures of the vibrating panel device, when the voice coil drives the vibrating panel to actuate, shaking of the vibrating panels while actuating is offset due to interactions between a pair of the suspensions and a pair of the vibrating panels, in such a manner that the voice coil drives the vibrating panel to process vertical up-and-down stroke, so as to replace a conventional damper.

In addition, when the vibrating panel device is applied in a passive radiator enclosure to serve as an auxiliary vibrator, by application of the upper suspension and the lower suspension, the vibrating panel is ensued to process vertical and balanced up-and-down stroke better.

Further, a manufacture method of a vibrating panel device for an electromagnetic vibrator is provided, which comprises the steps of:

putting the upper suspension and the vibrating panel into a base mold, integrating by insert molding to form the vibrating panel module; and fixedly mounting a pair of the vibrating panel module in opposite directions, so as to form the vibrating panel device.

The vibrating panel device for the electromagnetic vibrator of the present invention relies entirely on special designing of industrial structure and unique manufacture process to replace application of glue, so as to achieve an object of improving product quality and product qualification ratio.

These and other objectives, features, and advantages of the present invention will become apparent from the following detailed description, the accompanying drawings, and the appended claims.

DETAILED DESCRIPTION OF THE PREFERRED EMBODIMENT

Figure 1:
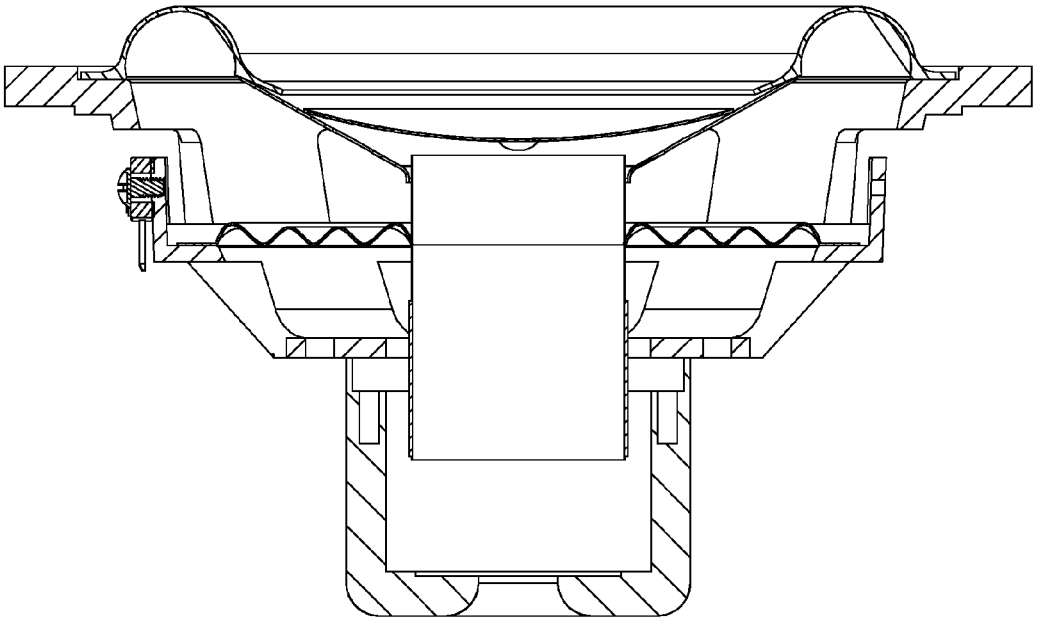
Fig. 1 Prior art
FIG. 1 is a sectional view of a conventional electromagnetic vibrating device.
Figure 2:
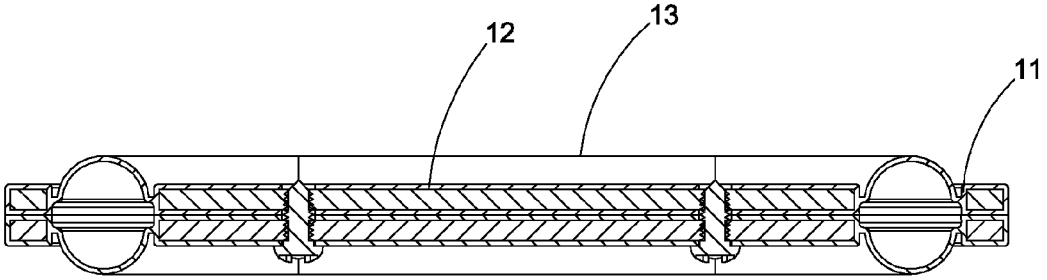
FIG. 2 is a sectional view according to a first preferred embodiment of the present invention.
Figure 3:
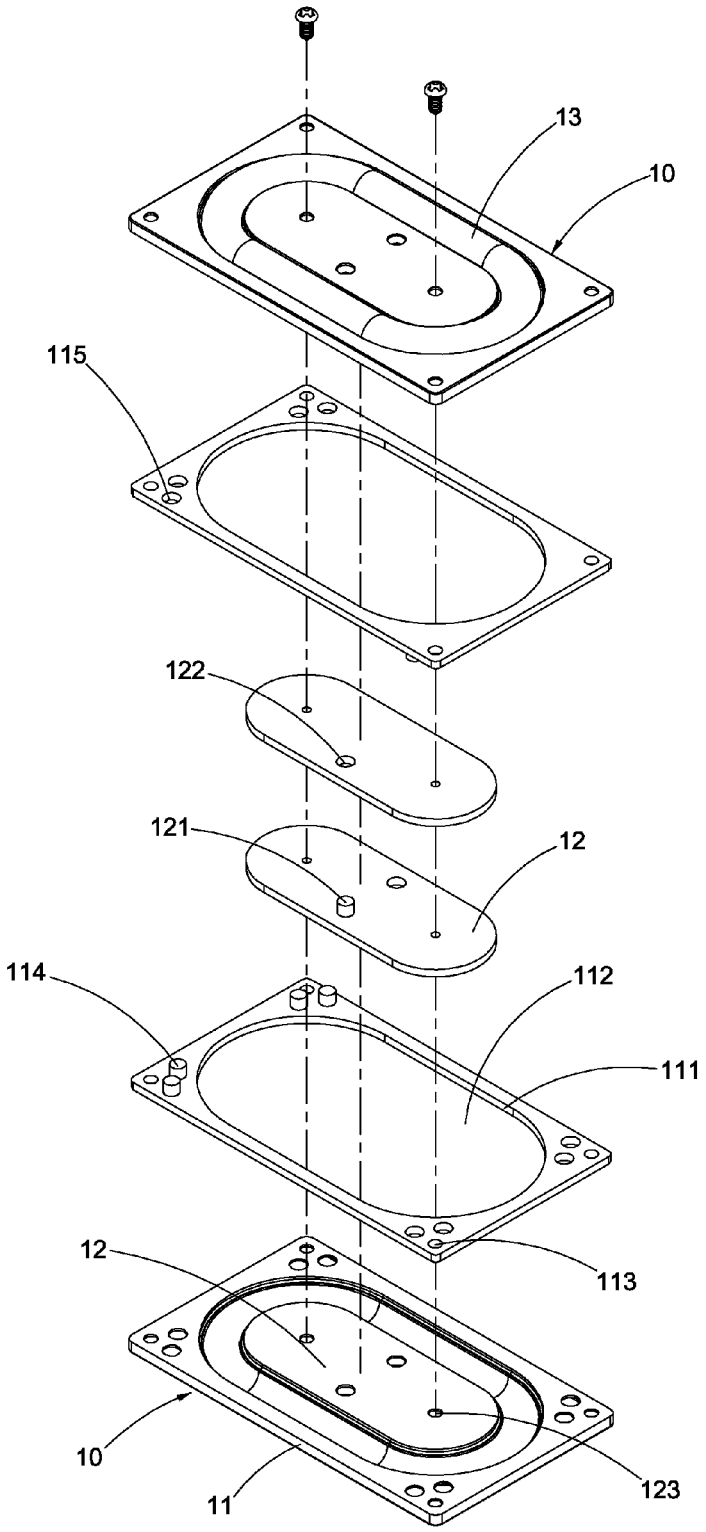
FIG. 3 is an exploded view according to the first preferred embodiment of the present invention.

Referring to FIG. 2 and FIG. 3 of the drawings, a vibrating panel device for an electromagnetic vibrator according to a first embodiment of the present invention comprises at least one vibrating panel module 10, wherein the vibrating panel module 10 comprises a base 11, a vibrating panel 12 and an upper suspension 13, wherein the base 11 has:

an inner surface 111 which circles inside the base 11, so as to form a through hole 112;

at least one connecting portion 113 provided on a periphery of a bottom of the base 11 for mounting a peripheral cone frame of the electromagnetic vibrator;

a first button 114 mounted on a first side of a bottom of the base 11; and a first button hole 115 mounted on a second side bottom of the base 11 for coupling with the first button 114, in such a manner that when a pair of the vibrating panel modules 10 are adopted, by rotating one vibrating panel module thereof for 180 degrees, the first button 114 and the first button hole 115 are fixedly buckled to form the vibrating panel device.

In addition, the vibrating panel 12 is provided on a middle portion of the through hole 112 on the base 11. The vibrating panel 12 has a second button 121 and a second button hole 122. The second button 121 is mounted on a first side of a lower surface of the vibrating panel 12, the second button hole 122 is provided on a second side of a lower surface of the vibrating panel 12 for coupling with the second button 121, in such a manner that when a pair of the vibrating panel modules 10 are adopted, by rotating one vibrating panel module thereof for 180 degrees, the second button 121 and the second button hole 122 are buckled to firmly bond the pair of the vibrating panel modules together.

Further, at least one mounting hole 123 is provided on the vibrating panel 12, in such a manner that when a pair of the vibrating panel module are adopted, the vibrating panels 12 of the pair of the vibrating panel modules 10 are better mounted via the mounting hole 123 in manners of locking screw and etc.

In addition, an inner edge of the suspension 13 is mounted on a periphery of an upper surface of the vibrating panel 12, and an outer edge of the suspension 13 is fixedly provided on the base 11.

It is worth mentioning that when the vibrating panel device is applied to an electromagnetic vibrator, an electromagnetic vibrator comprises a vibrating panel device, a voice coil, a magnetic circuit system and a peripheral cone frame, wherein a first end of the voice coil is fixedly provided on a voice coil mounting portion on a lower surface of the vibrating panel, a second end of the voice coil is provided in the magnetic circuit system; a first end of the peripheral cone frame is fixedly connected with the magnetic circuit system, a second end of the peripheral cone frame is fixedly connected with the connecting portion on the base, in such a manner that the whole electromagnetic vibrator is formed.

It is worth mentioning that by means of unique structures mentioned above, when the voice coil drives the vibrating panel to actuate, shaking of the vibrating panels while actuating is offset due to interactions between a pair of the suspensions and a pair of the vibrating panels, in such a manner that the voice coil drives the vibrating panel to process vertical up-and-down stroke.

Figure 6:
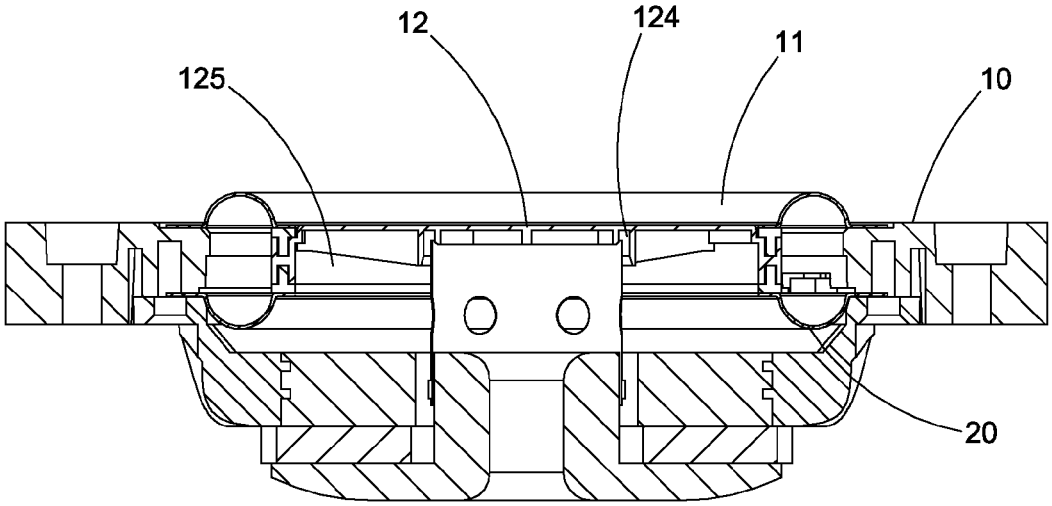
FIG. 6 is a sectional view according to preferred embodiments of the present invention, showing a vibrating device of the present invention serves as an auxiliary vibrator.

Referring to FIG. 6 of the drawings, it is worth mentioning that when the vibrating panel device is applied to a loudspeaker box to serve as an auxiliary vibrator, the vibrating panel device is mounted on an auxiliary vibrator mounting portion on a body of the loudspeaker box, in such a manner that acoustic wave generated by the loudspeaker while working drives the vibrating panel device to vibrate vertically and up-and-down with equal amplitude better.

Further, a manufacture method of a vibrating panel device for an electromagnetic vibrator is provided and comprises the steps of:

(a) putting the upper suspension and the vibrating panel into a base mold, integrating by insert molding to form a whole body, in such a manner that the vibrating panel module is formed;

(b) mounting a pair of the vibrating panel module in opposite sides, so as to form the vibrating panel device.

A second preferred embodiment of the present invention is as following.

Figure 4:
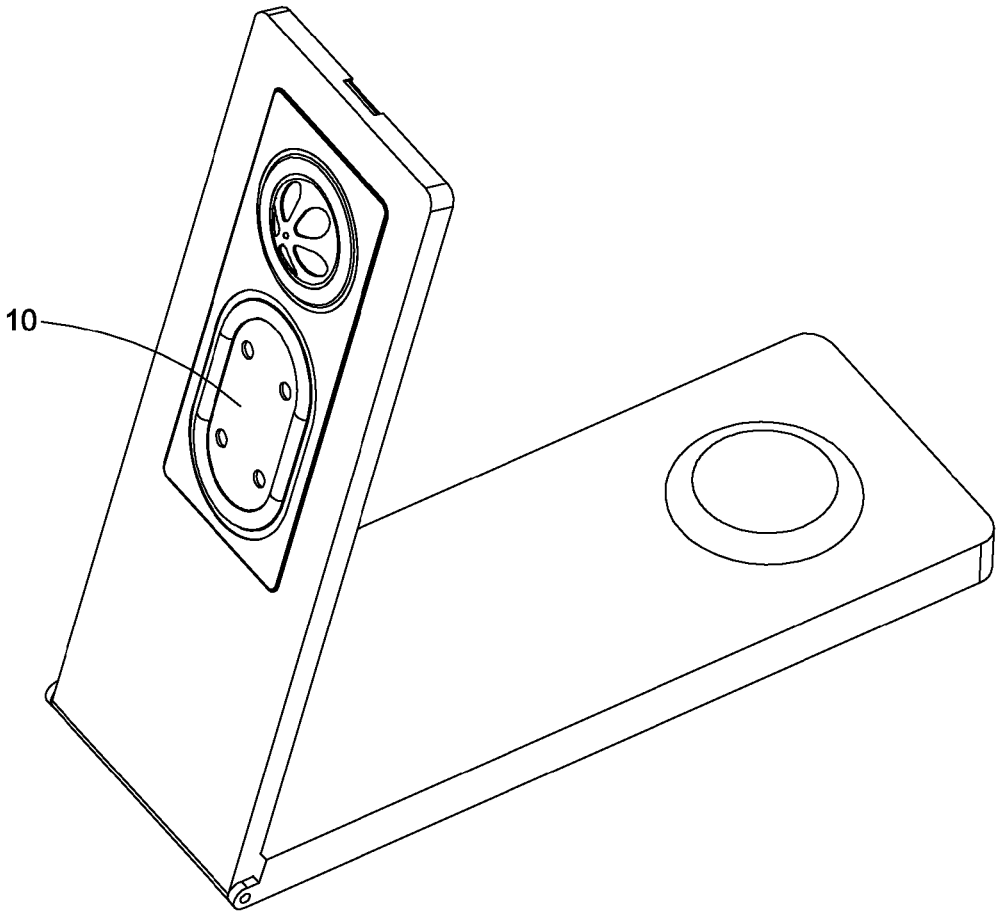
FIG. 4 is a bottom perspective view according to a second preferred embodiment of the present invention.
Figure 5:
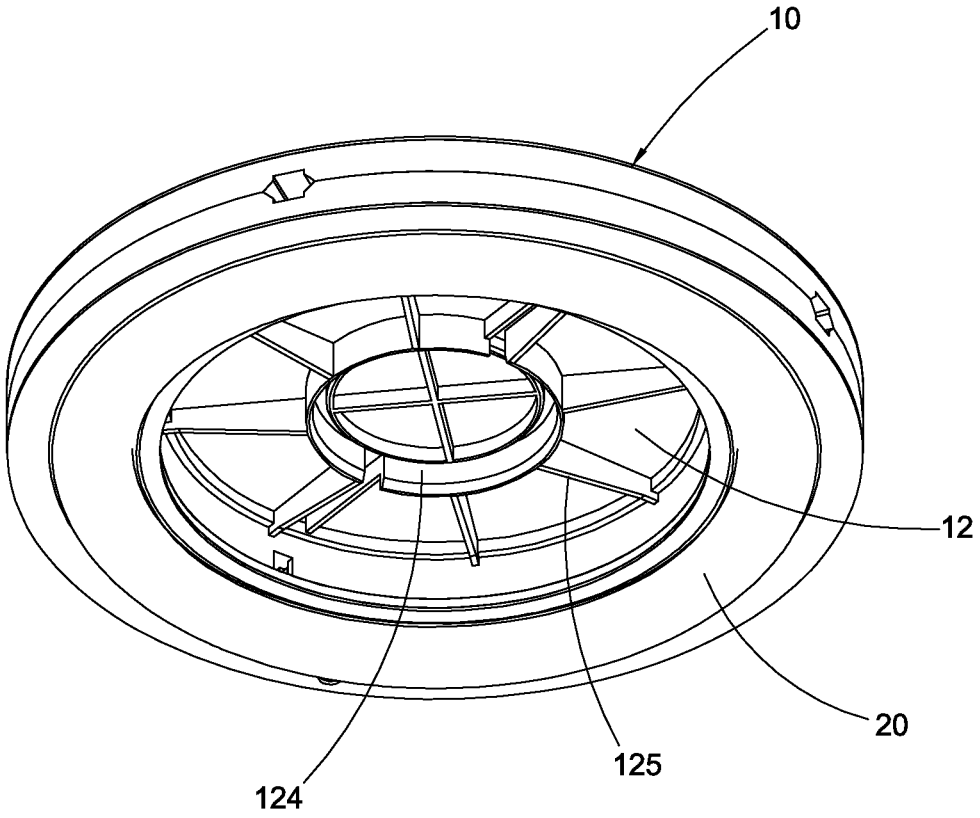
FIG. 5 is a bottom perspective view according to the second preferred embodiment of the present invention.

Referring to FIG. 4 and FIG. 5 of the drawings, a vibrating panel device for an electromagnetic vibrator is formed by the vibrating panel module 10 mentioned above and a lower suspension 20, wherein the lower suspension 20 and the upper suspension 13 of the vibrating panel 10 are in opposite directions, wherein an inner edge of the lower suspension is fixedly connected with a periphery of a lower surface of the vibrating panel 12, and an outer edge of the lower suspension is fixedly provided on the base 11.

Further, a voice coil mounting portion 124 is provided on a middle portion of a lower surface of the vibrating panel 12 for mounting an end of the voice coil of the electromagnetic vibrator onto the vibrating panel 12.

Further, a plurality of reinforcing ribs 125 are uniformly provided on the vibrating panel 12. The reinforcing ribs 125 uniformly and radically extend to periphery around the voice coil mounting portion 124, in such a manner that the vibrating panel 12 process vertical up-and-down stroke better while working.

Preferably, the voice coil mounting portion 124 is a groove which circles around a central point of the lower surface of the vibrating panel, for inserting and mounting an end of the voice coil of the electromagnetic vibrator onto the vibrating panel 12.

Preferably, the voice coil mounting portion 124 is a voice coil tray (not shown in the drawings) which is in a shape of a convex, a bottom of the voice coil tray is bonding fixed with a middle portion of a lower surface of the vibrating panel, a top of the voice coil tray is inserted by an end of voice coil and is bonded to fix the voice coil, so as to increase an area of a connection surface between the voice coil and the vibrating panel, in such a manner that the voice coil and the vibrating panel are better mounted.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A vibrating panel device for an electromagnetic vibrator, comprising:

a vibrating panel module which comprises two bases, which are first and second bases, each having a through hole and defining an inner surface around said through hole, a vibrating panel which is a rigid panel located within said through hole of said first base, and an upper suspension, which is made of flexible material, being mold-injected between said first base and said vibrating panel that said upper suspension is integrally extended from said first base to said vibrating panel to cover on an upper surface of said first base and an upper surface of said vibrating panel to form an integrated whole body, wherein a button and a button hole are respectively provided at said bases respectively, such that when said button is coupled at said button hole, said bases are coupled with each other; and a lower suspension fixedly coupled at said vibrating panel, wherein said lower suspension and said upper suspension are orientated in opposite directions, wherein an inner edge of said lower suspension is fixedly connected with a periphery of a lower surface of said vibrating panel, and an outer edge of said lower suspension is fixedly provided on said second base to form said vibrating panel device.

2. The vibrating panel device, as recited in claim 1, wherein a plurality of reinforcing ribs are uniformly provided on said lower surface of said vibrating panel, said reinforcing ribs uniformly and radially extend to a periphery around a voice coil mounting portion which is provided at a middle portion of said lower surface of said vibrating panel.

3. The vibrating panel device, as recited in claim 2, wherein said voice coil mounting portion is a groove which circles around a central point of said lower surface of said vibrating panel that said reinforcing ribs are radially extended from said groove for inserting and mounting an end of said voice coil of said electromagnetic vibrator onto said groove.

* * * * *